United States Patent [19]

Suzuki

[11] Patent Number: 4,570,525

[45] Date of Patent: Feb. 18, 1986

[54] ADJUSTABLE BOTTOM CLOSURE FOR A RESONATOR ON SOUND BAR TYPE PERCUSSIVE MUSICAL INSTRUMENTS

[75] Inventor: Shigeo Suzuki, Hamamatsu, Japan

[73] Assignee: Nippon Gakki Seizo Kabushiki Kaisha, Hamamatsu, Japan

[21] Appl. No.: 670,400

[22] Filed: Nov. 9, 1984

[51] Int. Cl.[4] ..... G10D 13/08

[52] U.S. Cl. ..... 84/410; 84/349

[58] Field of Search ..... 84/402–405, 84/410, 349, 350

[56] References Cited

U.S. PATENT DOCUMENTS

| | | | |
|---|---|---|---|
| 520,344 | 5/1894 | Weigle | 84/349 |
| 1,173,784 | 2/1916 | Deagan | 84/403 |
| 2,307,104 | 1/1943 | Bossard | 84/410 |
| 2,452,897 | 11/1948 | Bossard | 84/405 |

FOREIGN PATENT DOCUMENTS

| | | | |
|---|---|---|---|
| 16561 | 7 1911 | United Kingdom | 84/349 |

*Primary Examiner*—Lawrence R. Franklin
*Attorney, Agent, or Firm*—Sachs & Sachs

[57] ABSTRACT

A bottom closure for resonator of a sound bar on percussive musical instruments has a radially expandable construction for uniform pressure contact of a gasket with the resonator inner wall. Ideal follow-up of the bottom closure to the current shape of the resonator bottom end resulted from its elastic deformation assures almost perfect air leak prevention under any conditions.

9 Claims, 7 Drawing Figures

ADJUSTABLE BOTTOM CLOSURE FOR A RESONATOR ON SOUND BAR TYPE PERCUSSIVE MUSICAL INSTRUMENTS

BACKGROUND OF THE INVENTION

The present invention relates to an improved adjustable bottom closure for a resonator on sound bar type musical instruments, and more particularly relates to improvements in construction of a bottom closure used for defining the effective length of an associated tubular resonator on sound bar type percussive musical instruments such as marimbas, xylophones and vibraphones.

Generally, a sound bar type percussive musical instrument is provided with a graduated series of sound bars each tuned to a prescribed resonance frequency, and different sound bars are associated with tubular resonator of different lengths each closed at the bottom. When struck by a mallet, each sound bar generates a sound wave which drives air in the associated resonator for resonance thereby increasing the tone volume.

The resonance frequency f in Hz of a resonator is given by the following equation;

$$f=(V/4l)-(\text{correction}\times R/2)$$

where

V is the velocity of sound in m/sec, l is the effective length of the resonator in m, R is the inner diameter of the resonator, and the correction is a value in a range from 0.6 to 1.0.

Here, the velocity of sound V is given by the following equation;

$$V=340\ \text{m/sec}+(t-15)\times 0.6\ \text{m/sec}$$

where t is the ambient temperature in °C.

From these equations, it will be well understood that the value of the resonance frequency f of a resonator is greatly swayed by the value of the ambient temperature. In contrast to this, the frequency of the sound wave generated by an associated sound bar at striking is influenced by the ambient temperature in a reversed fashion. In order to make up for this gap in temperature influence, the resonator needs to be put in tune in accordance with the ambient temperature for best resonance.

To this end, it is usually employed to provide a resonator with an adjustable bottom closure which enables adjustment in effective length of the resonator depending on its set position within the resonator. A typical conventional bottom closure is given in the form of a simple cup-shaped piece associated with a gasket bonded to its outer surface. In use, the cup-shaped piece is inserted into the bottom of a resonater with the gasket in contact with the inner wall of the resonator. When the bottom end of the resonator is more or less deformed, this conventional simple construction cannot well follow the deformed shape of the resonator bottom end, thereby developing gaps between the gasket and the resonator inner wall which allows undesirable air leakage at resonance. In addition, when the axial direction of the cup-shaped piece is even a little off that of the resonator, like gaps are tend to be developed between the gasket and the resonator inner wall which promote undesirable air leakage at resonance.

In order to avoid this trouble, a new bottom closure was proposed in Japanese Utility model Publication sho.56-38553. In the case of this proposed construction, a base plate is secured in a resonator near its botton end and an adjuster rod is rotatably passed through a hole in the base plate while being blocked against axial diplacement. On the inner side, the point of the adjuster rod is in screw engagement with a mobile closure and, on the outer side, the adjuster rod is provided with a knob for manual operation. By manually turning the adjuster rod about its axis via the knob, the mobile closure slides up and down in the resonater for adjustment of the effective length of the resonator. In this case, the screw engagement of the mobile closure with the adjuster rod allows fine adjustment of the effective length and the axis of the closure can be always registered right at the axis of the resonator. Despite these advantages, this proposed construction cannot still provide good follow-up to possible deformation at the resonator bottom end. In addition, the proposed bottom closure is rather complicated in construction, which causes increased labour at installation and increased weight of the musical instrument. Further, the extent of displacement of the mobile closure, i.e. the extent of adjustment in effective length, to be provided by the screw engagement is too small to attain satisfactory tuning.

SUMMARY OF THE INVENTION

It is the basic object of the present invention to provide an adjustable bottom closure for a resonator which allows least air leakage at resonance with its excellent follow-up to any deformation in the resonator bottom end.

It is another object of the present invention to provide a bottom closure for a resonator which enables, despite its simple construction, wide range adjustment in effective length of the resonator.

In accordance with the basic aspect of the present invention, a bottom closure includes a tubular main body having a radially expandable section which, when arranged in a resonator, uniformly presses a tubular gasket embracing the main body tightly against the resonator inner wall by its radial expansion.

DESCRIPTION OF PREFERRED EMBODIMENT

Figure 1:
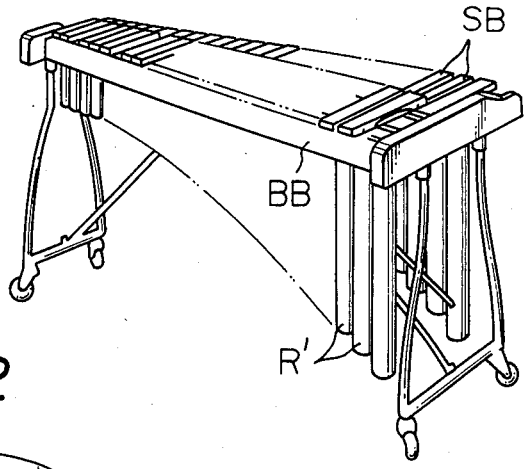
FIG. 1 is a perspective view of one example of a sound bar type percussive musical instrument to which the present invention is applied.

One example of a sound bar type percussive musical instrument is shown in FIG. 1, in which the instrument is provided with a graduated series of sound bars SB arranged on a base board BB and different sound bars SB are associated with tubular resonators R of different lengths arranged below them. The bottom closure in accordance with the present invention is adpated for use with such resonators R.

Figure 2:
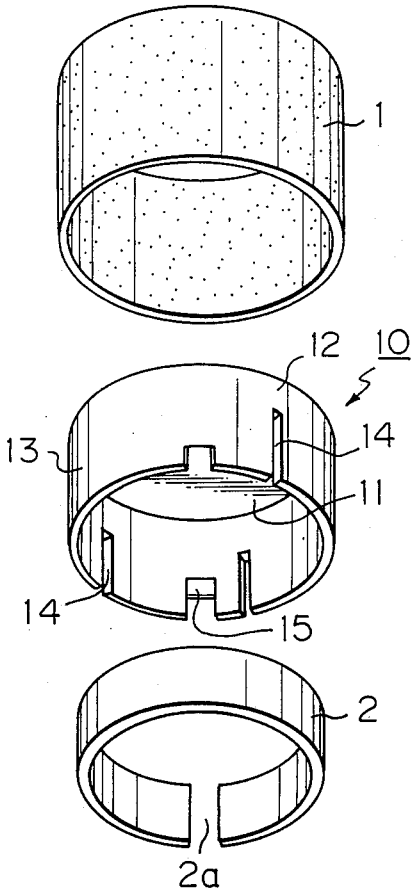
FIG. 2 is a perspective view of one embodiment of the bottom closure in accordance with the present invention in a disassembled state.

One embodiment of the bottom closure in accordance with the present invention includes a tubular gasket 1, a tubular main body 10 and a substantially tubular leaf spring 2 shown in FIG. 2. The tubular gasket 1 is in general made up of artificial leather or sheep skin and its outer diameter is almost the same as the inner diameter of a resonator R for which the bottom closure is to be used. The substantially tubular leaf spring 2 has a longitudinal cutout *2a*.

The tubular main body 10 is made up of a circular flat end wall 11, a continuous annular wall 12 extending longitudinally from the periphery of the end wall 11, and a discontinuous, radially expandable wall 13 extending further longitudinally from the annular wall 12 in one body therewith. Namely, the continuous annular wall 12 and radially expandable wall 13 form the side wall of the main body 10. The radially expandable wall 13 terminates at an open end, and includes at least one, and more preferably two or more, longitudinal slots 14 terminating at the open end. Preferably, the longitudinal slots 14 are located at equal circumferential intervals. In the case of the illustrated construction, the radially expandable wall 13 includes three longitudinal slots 14 located at equal circumferential intervals. At proper locations, the edge of the radially expandable wall 13 is turned to the inside to form a pair of spring holders 15.

In a free state, i.e. in a state with no load application, the outer diameter of the tubular main body 10 is roughly equal to the inner diameter of the tubular gasket 1 and the outer diameter of the tubular gasket 2 is larger than the inner diameter of the tubular main body 10.

Figure 3:
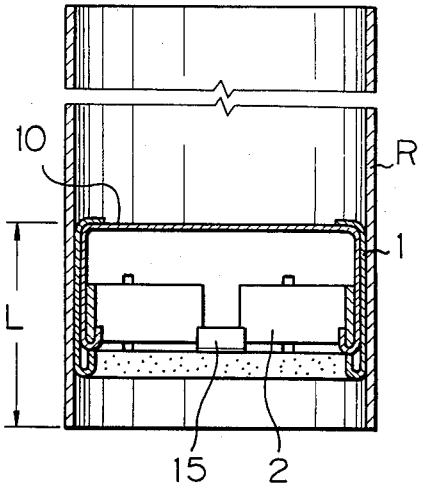
FIG. 3 is a side view, partly in section, of the bottom closure shown in FIG. 2 in the assembled state.

In use, the bottom closure is assembled to a resonator R, for example, as shown in FIG. 3, in which the bottom closure is arranged with its closed end up. More specifically, the tubular gasket 1 is inserted into the resonator R and the tubular main body 10 is inserted into the tubular gasket 1. The upper and lower ends of the tubular gasket 1 is turned down and properly bonded to the tubular main body 10. The tubular leaf spring 2 under manual squeeze is inserted into the tubular main body 10 and, after engagement with the spring holders 15 on the tubular main body 10, the manual squeeze is removed so that the tubular leaf spring 2 should resume its free state shown in FIG. 2. Resumption of the free state by the tubular leaf spring 2 causes radial expansion of the radially expandable wall 13 of the tubular main body 10 which is turn presses the tubular gasket 1 uniformly against the inner wall of the resonator R, thereby effectively preventing air leak from the resonator R. Even when the bottom end of the resonator R is locally deformed, the section of the radially expandable wall 13 corresponding to such a deformed location well follows up the deformed shape by its own elastic deformation at expansion, thereby leaving no gap at all for complete air leak protection. Likewise, any possible aging of the tubular gasket 1 develops no gaps at all thanks to its full pressure contact with the resonator R assured by the constant expansion of the tubular main body 10.

Alternatively, the bottom closure may be arranged in the resonator R with its closed end down. In this case, the end wall 11 of the main body 10 may be located flush with the bottom end of the resonator R. It will be clear from the illustration that the effective length of the resonator R can be adjusted over a distance L in the case of this embodiment.

Figure 4:
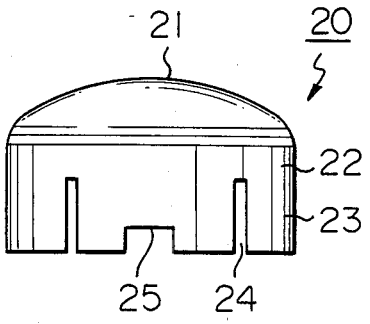
FIG. 4 is a side view of another embodiment of the main body of the bottom closure in accordance with the present invention.

Another embodiment of the bottom closure in accordance with the present invention includes a tubular main body shown in FIG. 4. Except for a convex end wall 21, the tubular main body 20 is substantially same in construction with the tubular main body 10 shown in FIG. 2. Namely, it includes a continuous annular wall 22 and a radially expandable wall 23 with longitudinal slots 24 and spring holders 25.

Figure 5:
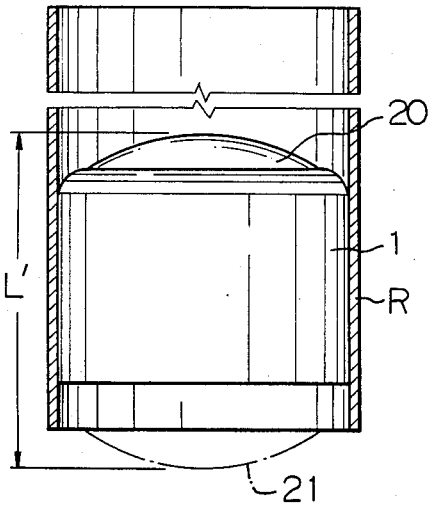
FIG. 5 is a side view, partly in section, of the bottom closure incorporating the main body shown in FIG. 4 in the assembled state.

In the assembly shown in FIG. 5, the bottom closure is arranged in the resonator R with its closed end up. As in the foregoing embodiment, however, the bottom closure may be arranged with its closed end down. In this case, the convex end wall 21 of the main body 20 may project from the bottom end of the resonator R as shown with a chain line in the illustration. It will be again clear from the illustration that the effective length of the resonator R is adjustable over a distance L' which is larger than the distance L for the foregoing embodiment.

Alternatively, the main body may be provided with a concave end wall. When a bottom closure with such a construction is arranged with its closed end down, the bottom end of the effective length of the resonator is apparently located above the bottom end of the resonator itself. As a consequence, the adjustable length for such a construction is smaller than the adjustable length L in FIG. 3.

It will be well understood from the foregoing that, in addition to the reliable air leak protection, the effective length of the resonator can be adjusted over a wide range by changing the design of the end wall of the tubular main body.

Figure 6:
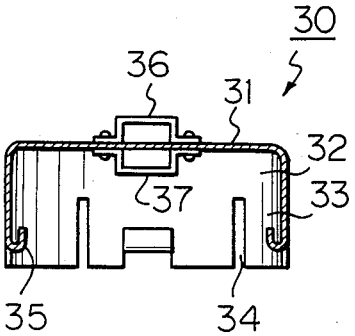
FIGS. 6 and 7 are side views, partly in section, of the other embodiments of the main body of the bottom closure in accordance with the present invention.

The other embodiment of the bottom closure in accordance with the present invention is shown in FIG. 6, in which a tubular main body 30 is provided with inner and outer handles 36 and 37. As for other points, the main body 30 is the same in construction with the tubular main body 10 shown in FIG. 2. Namely, it includes a flat end wall 31, a continuous annular wall 32 and a radially expandable wall 33 with longitudinal slots 34 and spring holders 35. This bottom closure is in particular suited for use with a resonator whose inner diameter is too small to allow easy insertion of user's hand. By using a properly hooked stick engageable with the handles 36 and 37, the position of the bottom closure in the resonator can be adjusted freely without insertion of user's hand.

As a substitute for the tubular leaf spring used for the illustrated embodiment, a ring spring of a round cross section with a cutout may be used for causing radial expansion of the tubular main body.

Figure 7:
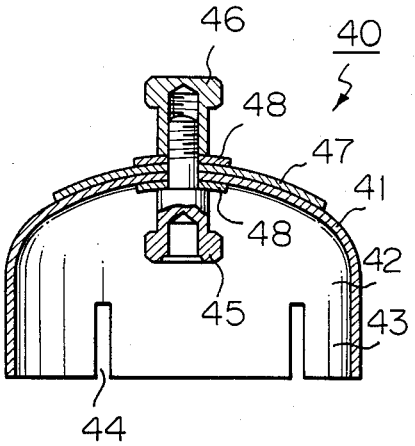

In the case of the foregoing embodiments, a tubular leaf or a ring spring with a cutout is used for causing radial expansion of the bottom closure. A further embodiment of the bottom closure in accordance with the present invention is shown in FIG. 7, in which, as a substitute for the tubular leaf spring, the curvature of the end wall of the tubular main body is utilized for causing radial expansion of the main body itself. More specifically, the tubular main body 40 has a convex end wall 41, an annular wall 42 and a radially expandable wall 43 of a spring material provided with longitudinal slots 44. No spring holder is provided. The convex end wall 41 is provided with a center hole through which a fastener bolt 45 extends outwards in screw engagement with a fastener nut 46. A proper backing 47 is sandwiched between a pair of washers 48. Further, though not illustrated, a proper elastic packing may be advantageously interposed between the washers 48 for firmer screw engagement of the fastener bolt and nut. After insertion of the tubular gasket 1 in a resonator 1 at assembly, the tubular main body 40 in a free state is inserted into the tubular gasket 1 and the fastener bolt 45 and the fastener nut 46 are fastened tightly. Thanks to the springy nature of the wall 43, this structure naturally causes elastic deformation, i.e. radial expansion, of the tubular main body 40 which presses the tubular gasket 1 uniformly against the inner wall of the resonator R.

It will be well understood that this construction can be applied to a bottom closure also whose tubular main body has a concave end wall.

I claim:

1. An improved adjustable bottom closure for a resonator on sound bar type percussive musical instruments comprising a tubular gasket, a tubular main body arranged in said gasket and including an end wall, and a side wall extending longitudinally from the periphery of said end wall and provided with at least one longitudinal slot, and means for causing radial expansion of said side wall in pressure contact with said gasket.

2. An improved adjustable bottom closure as claimed in claim 1 in which said radial expansion causing means is a substantially spring having a longitudinal cutout, and the outer diameter of said spring is larger than the inner diameter of said main body when both are in free states.

3. An improved adjustable bottom closure as claimed in claim 2 in which said spring is a leaf spring.

4. An improved adjustable bottom closure as claimed in claim 2 in which said main body further includes at least one spring holder formed by turning in the open end of said side wall.

5. An improved adjustable bottom closure as claimed in claim 1 in which said end wall of said main body is concave outwards.

6. An improved adjustable bottom closure as claimed in claim 1 in which said end wall of said main body is flat.

7. An improved adjustable bottom closure as claimed in claim 1 in which said main body further includes at least one handle attached to said end wall.

8. An improved adjustable bottom closure as claimed in claim 1 in which said end wall of said main body is convex outwards.

9. An improved adjustable bottom closure as claimed in claim 1 in which said radial expansion causing means is attained by the springy nature of said side wall.

* * * * *

UNITED STATES PATENT AND TRADEMARK OFFICE

CERTIFICATE OF CORRECTION

PATENT NO. : 4,570,525

DATED : Feb. 18, 1986

INVENTOR(S) : Shigeo Suzuki

It is certified that error appears in the above-identified patent and that said Letters Patent is hereby corrected as shown below:

In the Heading Add:

[30] Foreign Application Priority Date
Nov. 15, 1983 Japan..... 58-175455

In the Specification:

Column 3, line 51; delete "is" and insert therefor --in--.

Signed and Sealed this

Tenth Day of June 1986

[SEAL]

Attest:

DONALD J. QUIGG

Attesting Officer

Commissioner of Patents and Trademarks